United States Patent [19]

Rohr

[11] Patent Number: 4,582,009

[45] Date of Patent: Apr. 15, 1986

[54] SEWING MACHINE THREAD TRIMMING MECHANISM

[75] Inventor: Günter H. Rohr, Hemmingen, Fed. Rep. of Germany

[73] Assignee: Union Special GmbH, Stuttgart, Fed. Rep. of Germany

[21] Appl. No.: 668,535

[22] Filed: Nov. 5, 1984

[30] Foreign Application Priority Data

Nov. 17, 1983 [DE] Fed. Rep. of Germany ..... 3341456

[51] Int. Cl.[4] ..... D05B 65/00

[52] U.S. Cl. ..... 112/287; 112/285

[58] Field of Search ..... 112/DIG. 1, 285, 286, 112/287, 288, 295, 298, 300, 301, 291, 292, 297, 129, 130, 293, 294, 296; 30/74, 266, 267; 83/583, 584, 585; 7/901

[56] References Cited

U.S. PATENT DOCUMENTS

| | | | |
|---|---|---|---|
| 2,109,507 | 3/1938 | Salz | 30/74 |
| 2,643,579 | 6/1953 | Jacoby, Jr. | 30/74 |
| 2,792,108 | 5/1957 | Keller | 30/74 X |
| 3,418,953 | 12/1968 | Fowler | 112/287 |
| 3,624,734 | 11/1971 | Schips | 112/288 |
| 3,660,894 | 5/1972 | Sand | 30/74 |
| 3,749,040 | 7/1973 | Jurgens | 112/288 |
| 3,922,983 | 12/1975 | Schips et al. | 112/288 |
| 4,332,209 | 6/1982 | Gauch | 112/287 |

*Primary Examiner*—Werner H. Schroeder
*Assistant Examiner*—Joseph S. Machuga
*Attorney, Agent, or Firm*—John A. Schaerli; Powell Sprunger

[57] ABSTRACT

A thread trimming mechanism including a pair of knives for severing thread disposed therebetween. The knives are magnetically attracted to each other such that a cooperative cutting relationship is maintained therebetween.

1 Claim, 3 Drawing Figures

FIG. 1
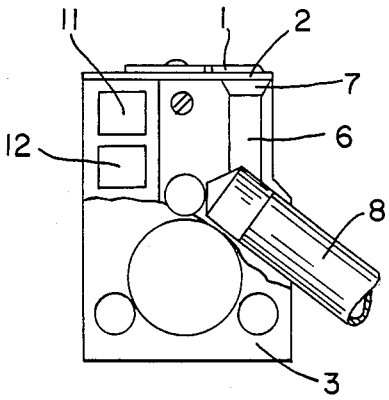
FIG. 2
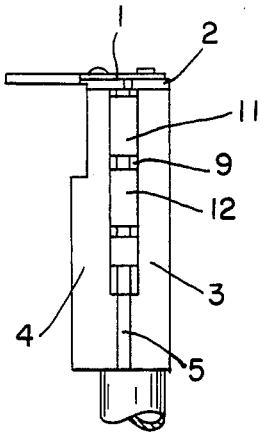
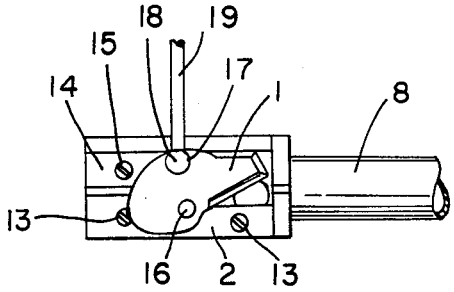
FIG. 3

SEWING MACHINE THREAD TRIMMING MECHANISM

FIELD OF THE INVENTION

This invention relates to sewing machines and, more particularly, to thread trimming mechanisms for sewing machines.

BACKGROUND OF THE INVENTION

Thread cutters or trimmers for sewing machines are well known in the art. In such cutters, the knives are frequently made of spring steel and/or are biased against one another under the influence of a spring. U.S. Pat. No. 4,332,209 to H. Gauch is one example of a thread trimming mechanism which employs a spring for biasing one blade against another. With either construction, the knives must press against each other such that the sliding pressure engagement therebetween is sufficient to operationally maintain a cutting relationship.

Although thread trimmers and cutters have been long known, diadvantages and drawbacks remain. The knives made of spring steel have a relatively high manufacturing cost because of their special shape and tolerances. As may be appreciated, those knives which are influenced into pressing engagement with each other by a spring require accurate calibration of the spring pressure. Too much pressure and the knife blade wear is intolerable. Too little pressure and the cutting relationship between the blades suffers. To accomplish and maintain the proper spring adjustment can be a timely, and thus costly process.

SUMMARY OF THE INVENTION

In view of the above, and in accordance with the present invention, there is provided a thread trimming mechanism which overcomes the disadvantages inherent with the heretofore known thread trimming devices. The problem of high cost is solved by using parts having a simple design not requiring the difficult to achieve tolerances of spring steel parts. The problem of rapid wear is overcome by devising an apparatus wherein a consistent and predetermined sliding pressure engagement between the blades is achieved.

To accomplish these ends, the present invention provides a thread severing means including at least one reciprocally driven blade or knife and at least one stationary blade or knife. Both blades are carried on a supporting structure in which a negative pressure or suction is created. The suction serves to draw thread between the knives for subsequent severance thereof.

The key feature of the present invention is the method by which the sliding pressure engagement between the blades is established. Rather than using spring steel or inaccurate spring pressures, the present invention utilizes magnetic force for establishing and maintaining the sliding pressure engagement between the blades. In the preferred embodiment, the support means carries one or more magnetic means whose influential field lines pass through the blades whereby maintaining same in a cooperative thread cutting relationship relative to each other.

In line with the above, a primary object of the present invention is the provision of a thread trimming mechanism which uses magnetic force for influencing the sliding pressure contact between the thread trimming blades.

It is another object of this invention to provide a thread trimming assembly which is simple in operation and economical to manufacture.

BRIEF DESCRIPTION OF THE DRAWINGS

Having in mind the above objects and other attendant advantages that will be evident from an understanding of this disclosure, the invention comprises the devices, combinations, and arrangement of parts as illustrated in the presently preferred embodiment of the invention which is hereinafter set further in detail to enable those skilled in the art to readily understand the functions, operation, construction and advantages of it when read in conjunction with the accompanying drawings in which:

FIG. 1 is a view schematically illustrating the presently preferred form of the invention;

FIG. 2 is a side view of the device illustrated in FIG. 1; and

FIG. 3 is a top plan view of the device illustrated in FIG. 1.

DETAILED DESCRIPTION OF THE PRESENT INVENTION

For purposes of clarity, the details of a sewing machine to which the sewing machine may be applied are not shown herein. Suffice it to say, the present device, for example, may be applied to a wide variety of machines including an overedge sewing machine such as that shown in U.S. Pat. No. 2,704,042 to Wallenberg, et al; a combined overedge and chainstitch sewing machine as shown in U.S. Pat. No. 2,973,730 to Schweda, et al; or, a flatbed chainstitch sewing machine of the type well known in the art.

Turning now to FIGS. 1 through 3 of the drawings, wherein like reference numerals indicate like parts throughout the several views, there is illustrated a thread trimming mechanism or assembly. The thread trimmer or cutter assembly of the present invention includes a pair of blade or knife means 1 and 2 which are capable of severing thread disposed therebetween. In the preferred embodiment, the blades are illustrated in a horizontal disposition but it should be appreciated that alternative arrangements are within the spirit of the present invention. A housing provides the means for supporting the trimming blades in a predetermined horizontal arrangement and further permits operator adjustment of the blades disposition at any preferable height or distance from a fixed location or surface. The housing or support means includes side by side or adjacent magnetically permeable or reactive blocks 3 and 4 having a nonmagnetic, i.e. brass, spacer 5 disposed therebetween. The knife support means is provided with a passageway 6 into which thread may be readily drawn by a suction created in the passageway by a suction tube 8. As best illustrated in FIGS. 1 and 3, the thread severing means are disposed at the orifice 7 of the passageway 6 such that the knife means are disposed mutual distances from and on opposite sides of the oriface or inlet 7. By such construction, the suction created in the passageway introduces thread between the blade means for severance thereof.

Unlike the present invention, other thread trimming mechanisms use screws and springs for applying pressure between the knives. In contrast, the present invention utilizes magnetic force or influence for providing the necessary sliding pressure engagement between the knifes. To accomplish this end, the present invention includes magnetic means 11 and 12. In the present embodiment, permanent magnets are preferably used. The magnets may be accommodated in recesses 9 provided in the blocks 3 and 4 such that the opposite poles of the magnets are directed against the oppositely placed blocks 3 and 4.

The thread severing means of the present invention includes at least one movable blade and at least one fixed blade to provide a scissor cutting action for the thread. In the illustrated embodiment, knife 1 serves as the movable cutter blade. Knife 2 is a fixed cutter blade which additionally may form a portion of one of the blocks comprising the knife support means. The knife 2 is secured to the block by fasteners 13. To maintain the cutting edges of the blade disposed in adjacent parallel planes, the other block is provided with a magnetically permeable spacer 14 which is attached to the block by means of fasteners 15. The blades are pivotally interconnected about an upstruck pin 16 carried by the support means and whose longitudinal axis extends generally perpendicular to the disposition of the blades.

The movable cutter blade may be reciprocally actuated or driven through a link 19. One end of the link 19 is provided with a bearing lug or ball 18 which is accommodated in a suitable recess 17 provided in the knife means 1. The other end of the link 19 is operatively connected, through any suitable means to a driven part of the machine or with a seperate drive similar to that illustrated in U.S. Pat. No. 4,332,209 to H. Gauch; the full disclosure of which is incorporated herein by reference. Suffice it to say, the blade 1 is reciprocally driven during machine operation.

As mentioned above, the magnetic attraction between the knives supplies the necessary sliding pressure engagement without the aid of additional screws and springs. That is, the magnetic field or field lines of the magnets 11 and 12 proceed through the magnetically permeable blocks 3 and 4, through the spacer 14 and ultimately through the knives 1 and 2. The path of the magnetic field lines urges the knives against each other whereby maintaining a cooperating cutting relationship therebetween.

Besides the illustrated form of the invention there are other possible and realizational embodiments within the scope of the present invention. For example, the support means may consist of one piece of nonmagnetically permeable material, i.e., brass, in which at least one magnet is housed. In such construction, one pole of the magnet would be associated with the knife means 2 and the other magnetic pole would be associated with the spacer 14. As a skilled artesian will appreciate the benefits resulting from the illustrating embodiment would likewise be shared under such alternative embodiments.

Thus, it is apparent that there has been provided, in accordance with the invention, a Sewing Machine Thread Trimming Mechanism that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Thus, having adequately described the invention, what I claim is:

1. A thread trimming mechanism comprising:

a supporting means having a passageway formed therein, said passageway having an inlet end means and side by side adjacent magnetically permeable block means having a nonmagnetic means disposed therebetween;

means for creating a suction in said passageway for drawing thread thereinto through said inlet end means; and thread severing means disposed a mutual distance from and on opposite sides of said inlet means, said thread severing means including at least two blade means which are biased against one another by a magnetic force from said side by side adjacent magnetically permeable block means, in a manner to maintain a cooperative cutting relationship therebetween.

* * * * *